US005491616A

United States Patent [19]

Reed

[11] Patent Number: 5,491,616

[45] Date of Patent: Feb. 13, 1996

[54] HEAT INDUCED ROTATING LAMP SHADE

[75] Inventor: Patricia M. Reed, Portland, Oreg.

[73] Assignee: Daisy Kingdom, Portland, Oreg.

[21] Appl. No.: 182,787

[22] Filed: Jan. 13, 1994

[51] Int. Cl.[6] ..... F21V 21/30

[52] U.S. Cl. ..... 362/35; 40/441; 362/354; 362/806

[58] Field of Search ..... 362/961, 294, 362/354, 356, 444, 325, 35, 806, 808, 811, 438; 40/441

[56] References Cited

U.S. PATENT DOCUMENTS

| | | | |
|---|---|---|---|
| 2,398,974 | 4/1946 | Storm | 362/35 |
| 2,876,339 | 3/1959 | Thorne | 40/441 |
| 3,263,353 | 8/1966 | Quinn | 40/441 |

*Primary Examiner*—Stephen F. Husar
*Attorney, Agent, or Firm*—Robert L. Harrington

[57] ABSTRACT

A lamp shade mounted on a lamp and rotatable thereon. A shade having a conical shape is supported on the lamp on a support member. The shade and the support member have cooperative bearing members to facilitate the free rotation of the shade. Slits are provided in the lamp shade surface that permit the projection of a portion of the lamp shade material from the defined conical surface of the shade to define unidirectional vanes. Air warmed by the bulb of the lamp when lit rises within the conical shape of the shade and exits through the slits and imparts a force on the vanes to cause the lamp shade to rotate. The support member for the shade is removably mounted to the lamp to facilitate transferring the support member and thus the shade from lamp to lamp. One support member is arranged to be removably clamped to the socket of the lamp and an alternative support is removably mounted to the bulb installed in the lamp.

4 Claims, 1 Drawing Sheet

HEAT INDUCED ROTATING LAMP SHADE

FIELD OF INVENTION

This invention is directed to a decorative lamp shade and more particularly to a rotating decorative lamp shade wherein rotation is induced by heat emitted from the lamp.

BACKGROUND OF THE INVENTION

Heat induced rotating lamp shades are not new. They have existed for many years although they are not considered to be a common or popular household item.

A cone-shaped lamp shade is provided with curved (non-linear) slits having concave sides that are laterally directed and all facing the same direction, i.e., they are unidirectional. The material of the shade outlined by the slits is deflected slightly outwardly from the cone which provides an air opening whereby the deflected material form unidirectional vanes. The cone-shaped lamp shade is suspended over a heat source, e.g., a light bulb. A wire or slim rod having its end projected into the apex of the cone supports the cone. The end of the rod provides a bearing surface as does the apex of the cone so that the cone is free to rotate on the rod end. Heated air rises inside the cone and escapes out the formed openings. In doing so the air pushes against the formed vanes and because the vanes are formed to direct the air in a common direction, the flow of air against the vanes induces rotation of the cone.

As mentioned, the heat-induced rotating lamp shade as generally described has previously been available but has not been a popular household item. There are a number of reasons. A primary object of a lamp is to provide light. The cone-shaped shade blocks much of the light and on occasion it is desirable to remove the shade. Typically the wire or rod support is permanently attached to the lamp base and alternative lamp shades are not adaptable to it. Whereas the rotating lamp shade is a desired novelty, purchasing an entire lamp dedicated to that novelty is not desirable. It may be desirable to transfer the rotating shade from lamp to lamp which is not achievable with prior rotating lamp shades.

BRIEF SUMMARY OF THE INVENTION

The present invention improves on the prior rotating lamp shades in several respects. The wire support is provided with a clip-on base portion. In the preferred embodiment, a clip-on base portion is adapted to clip onto the socket portion of the lamp. Whereas sockets for lamps are standardized, the wire or rod support can be moved from lamp to lamp as desired. Alternatively the clip-on base portion is adapted to clip onto the light bulb.

A further improvement is directed to the bearing surface provided in the cone tip of the shade. Whereas these tips are subjected to long durations of heat from the light bulb, and are subjected to a wearing problem resulting both from the repeated attempts to remove and replace the cone as well as the rotation of the cone, the bearing provided in the cone tip of the present rotating shade is made both heat resistant and more easily fitted to the wire end.

Still further is the discriminate provision of the slits which form the air openings. The shade is decorated with figures and the slits are provided at the outlines of the figures to give the figures a three-dimensional effect while also camouflaging the slits.

These and other advantages will become more apparent upon reference to the following detailed description and drawings referred to therein.

DESCRIPTION OF THE PREFERRED EMBODIMENT

Figure 1:
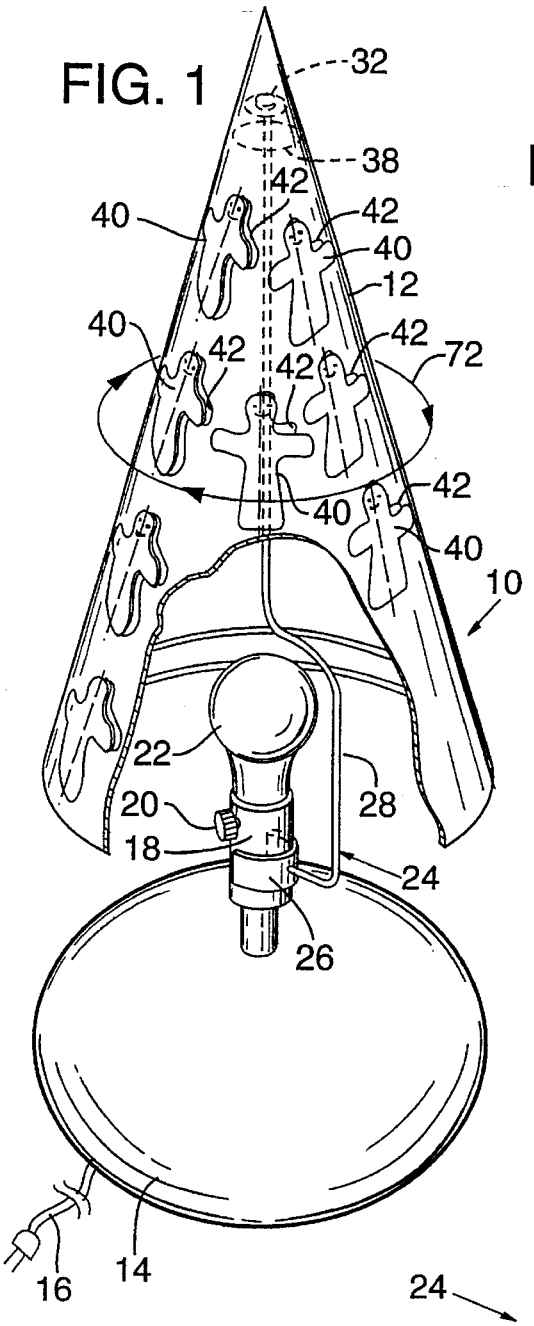
FIG. 1 is a view of a rotatable lamp shade of the present invention mounted on a lamp.

Refer to FIG. 1 of the drawings which illustrates a lamp 10 fitted with a rotatable conical shade 12 of the present invention. The lamp 10 has a base 14 and a conventional electrical cord 16 for connecting the lamp to a source of power. A conventional lamp socket 18 is mounted to the base 14 and a light bulb 22 is installed in the socket 18. A switch 20 is provided in the socket 18 to turn the power on and off.

Figure 4:
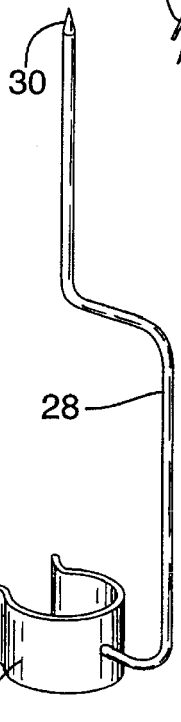
FIG. 4 is a view of a support for supporting the rotatable lamp shade on the lamp of FIG. 1.

The shade 12 is mounted to the lamp 10 on support member 24 removably mounted to the socket 18. The support member has a resilient clamp (claw) 26 that is arranged to fit the contour of the socket 18. The support member 24 has a shaped rod 28 that extends upwardly around and above the bulb 22 when the support member 24 is mounted on the socket 18. The upper end 30 of the rod 28 (see FIG. 4) is tapered to form a bearing member. The support member 24 may thus be moved from lamp to lamp as desired.

Figure 2:
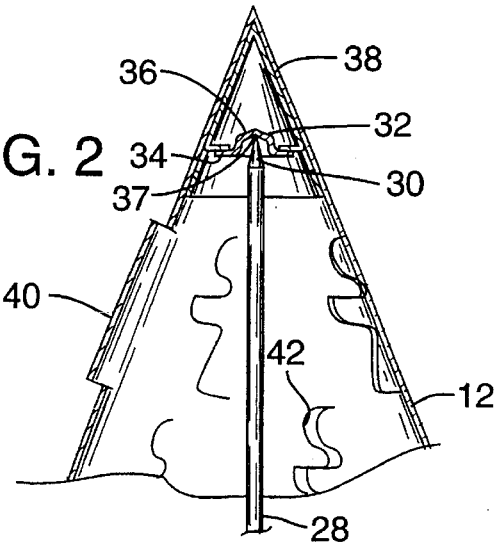
FIG. 2 is a partial sectional view of the rotatable lamp shade of FIG. 1.

The shade 12 is conical in shape and has a bearing 32 installed in its apex 31 (best seen in FIG. 2). The bearing 32 is preferably of a highly heat and wear resistant material, such as metal. The bearing 32 is a shaped member having a peripheral tapered flange 34 that surrounds a substantially spherical center 36. A dimple 37 is centrally located in the spherical center 36. In this embodiment the bearing 32 is fixedly mounted in a separate cone 38 for ease of properly positioning the bearing 32. The cone 38 with the bearing 32 installed is fitted in the apex 31 of the shade 12 as by gluing.

Figure 3:
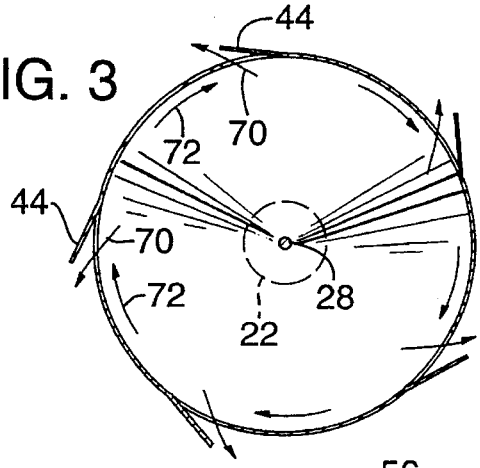
FIG. 3 is a sectional view of the rotatable lamp shade of the present invention of FIG. 1.

The shade 12 in this embodiment has outlines of figures 40 on its external periphery for aesthetic appeal. Slits 42 are provided in the surface of the shade 12 with the slits 42 being at a side edge of the figures 40 and generally following a portion of the outline of each figure. In this embodiment the slits 42 are generally provided at the right side edge of the figures (as viewed in the drawing). The slits 42 permit projecting or bending a portion of the outline of the figures 40 (shade material) away from the defined surface of the conical lamp shade 12 as shown in FIG. 3 and in effect define unidirectional vanes 44. The projection or bending of a portion of the figure away from the conical surface of the shade 12 tends to provide a three dimensional effect for the figures and also camouflages the slits.

Figure 5:
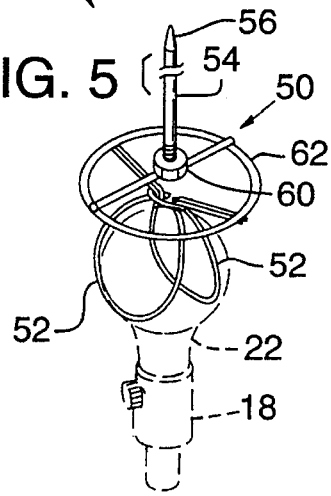
FIG. 5 is a view of an alternate support member for supporting the rotatable shade of the present invention on the lamp of FIG. 1.

An alternate support member 50 is illustrated in FIG. 5. The support member 50 has opposed loops 52 that are sized to fit over the bulb 22 installed in the lamp 10. The loops 52 are biased toward each other and will yieldably separate to permit installing the support member 50 on the bulb 22. The support member 50 has a rod 54 that will extend upwardly from the bulb 22 when the support member 50 is fitted to the bulb 22. The rod 54 is threadably installed in a nut 60 of the base 62 of the support 50. This mounting arrangement facilitates interchanging rods 54 of different lengths to accommodate shades 12 of varying sizes. The upper end 56 of the rod 54 is preferably tapered to form a bearing member which will fit in the bearing 32 fitted to the shade 12.

The shade 12 and the support member 24 are installed on the lamp 10 as illustrated in FIGS. 1 and 2 (Alternatively the supporting member 50 may be utilized to support the shade 12). The shade 12 is mounted on the support member 24 with the bearing member 30 on the upper end of the rod 28 being received in the dimple 37 of the bearing 32 of the shade 12. The bearing member 30 on the upper end of the rod and the bearing 32 fitted to the shade 12 are arranged to provide minimum resistance to rotation. The shade 12 is thus mounted to the lamp 10 in a freely rotating manner.

When the bulb 22 is lit it will generate heat. The heat generated will warm the air surrounding the bulb 22 causing it to rise. The rising warm air will travel upwardly inside the conical shade 12 with the air escaping out the slits 42 provided in the surface of the shade 12 as indicated by arrows 70 in FIG. 4. The warm air escaping through the slits 42 will apply a force to the unidirectional vanes 44 which will cause the shade 12 to rotate in the direction indicated by arrow 72 in FIGS. 1 and 4.

Those skilled in the art will recognize that variations and modifications may be made without departing from the true spirit and scope of the invention. For example, while only one type of bulb has been illustrated, it will be apparent that the support members 24, 50 may be readily altered to suit sockets and bulbs of other shapes. In a less desirable embodiment, the slits in the shade 12 need not conform to the outline of the figure but may be provided in a configuration to suit. The invention is therefore not to be limited to the embodiments described and illustrated but is to be determined from the appended claims.

What is claimed is:

1. A heat induced rotatable lamp shade adapted to fit a shadeless lamp having an exposed light bulb fitted to a socket comprising:

a cone-shaped shade and support rod;

said cone-shaped shade having an apex tip portion provided with a bearing and said support rod having an end provided with a mated bearing for low friction rotation of the shade on said support rod;

said cone-shaped shade provided with discriminate openings forming unidirectional vanes whereby heat generated from the light bulb flows upwardly through said openings and against said vanes to produce rotation of said shade on said rod; and said cone-shaped shade having an exterior decoration including multiple figures defining figure outlines, said openings provided by non-linear slits that define shade portions that are projected from the cone surface to produce the vanes, said slits provided along selected figure outlines to provide the figures with a three-dimensional appearance.

2. A heat-induced rotatable lamp shade as defined in claim 1 wherein said support rod is provided with a clip-on base portion for removable attachment of said support rod to the shadeless lamp whereby the bearing of the rod is projected above the light bulb.

3. A heat-induced rotatable lamp shade as defined in claim 2 wherein the bearing in the top of the lamp shade is a member separate from the material of the lamp shade and is an insert into the apex of the lamp shade, said member having a center depression for receiving the bearing end of the rod, and a flared portion surrounding the depression for receiving the bearing end and urging centering thereof into the depression.

4. A heat-induced rotatable lamp shade as defined in claim 3 wherein the insert member is heat resistant to resist deformation and deterioration from the heat generated by said light bulb.

* * * * *